United States Patent [19]

Lyell

[11] 4,186,543

[45] Feb. 5, 1980

[54] FOOD PROCESSOR

[75] Inventor: Charlie D. Lyell, Martin, Tenn.

[73] Assignee: Sharon N. Lyell, Martin, Tenn. ; a part interest

[21] Appl. No.: 904,801

[22] Filed: May 11, 1978

[51] Int. Cl.[2] ..... B02C 1/02; B02C 18/02; B65B 63/00

[52] U.S. Cl. ..... 53/515; 83/147; 83/157; 83/356.2; 99/571; 99/582; 241/94; 241/95; 241/100; 241/262; 241/273.2; 241/274; 241/283

[58] Field of Search ..... 53/515, 55; 83/355, 83/356.2, 856, 408, 147, 157, 167; 241/263, 265, 266, 267, 94, 95, 276, 283, 262, 282.1, 274, 282.2, 100, 233.2; 99/571, 582

[56] References Cited

U.S. PATENT DOCUMENTS

| | | | |
|---|---|---|---|
| 1,794,833 | 3/1931 | Castellucci | 241/283 |
| 1,987,910 | 1/1935 | Prickett | 241/283 |
| 2,311,618 | 2/1943 | Coleman | 83/157 |
| 2,343,757 | 3/1944 | Egedal | 241/100 X |
| 2,707,503 | 5/1955 | Johnson et al. | 241/262 X |

*Primary Examiner*—Mark Rosenbaum

[57] ABSTRACT

A versatile food preparing machine which includes various attachments for selectively processing many different kinds of foods. The machine is characterized by incorporating a bottomless hopper and a food support pad for restingly supporting the food at various levels as it protrudes downwardly from the hopper. An interchangeable reciprocatable food processable element, e.g., a knife or shredder/grater element, etc., workingly engages the food by cyclically moving between the hopper and the adjustable food support pad, e.g., whereby slices of various thicknesses may be made from certain kinds of foods. Ejector structure cyclically ejects particles of the processed food, e.g., slices of okra and the like, downwardly away from the food processable element. Particular structure is also included for collecting the ejected slices of food to facilitate subsequent storage thereof in a food freezer.

11 Claims, 23 Drawing Figures

FOOD PROCESSOR

BACKGROUND OF THE INVENTION

1. Field of the Invention

This invention relates to the field of food processing machines and is particularly directed toward those type food processing machines which incorporate reciprocating knifes and the like.

2. Description of the Prior Art

The state of the art as known by the applicant includes the various well known food processors currently being marketed under various trade names. In addition, applicant is aware of the following U.S. Pat. Nos. 131,127 granted to Smith over a century ago; 567,392 granted to Hough; 2,169,323 granted to Martinet; 2,465,266 granted to Rieder; and 3,150,701 granted to Zimmerman. However, none of the above mentioned machines suggest or disclose applicant's device.

Modern day food processors predominately depend upon rotating discs for their cutting elements. These discs are limited in their ability to cut certain foods. For example, the inherent slippery characteristics of okra hinders these type blades from preparing optimum slices. Also, these type food processors require the operator to constantly be attending to the operation thereof, i.e., the food contained in the hopper is not self feeding through the disc blade structure. Therefore, the user is hampered or limited by the fact that he cannot free his hands for getting other food ready for inserting into the hopper. Additionally, the act of sharpening disc blades is a difficult task, indeed, it can only be accomplished by special equipment not available in the usual household.

SUMMARY OF THE INVENTION

The present invention is directed towards overcoming the disadvantages and problems relative to previous food processing machines. An important feature of the present invention is that the reciprocating knife or food processable element, enables the users hands to be free so that he may be getting other food ready to insert into the hopper, i.e., such as cutting stems off okra, carrots, cucumbers, squash, peeling bananas, shelling eggs, etc. Also, the reciprocating motion of the knife and the free travel of the food down the hopper, enable more delicate types of food to readily be processed, i.e., slicing bananas, tomatoes, boiled eggs, etc. Additionally, the blade may readily be removed for cleaning and sharpening in a conventional manner, i.e., the blade may be sharpened like any other knife on a flat sharpening stone.

The food processor of the present invention is versatile since it includes various attachments for selectively processing many different kinds of foods, e.g., slicing okra and other elongated vegetables, cutting potatoes for french fries, cracking nuts, and shredding and grating such foods as cabbages and coconuts. The machine is characterized by incorporating a set of bottomless hoppers which individually may be removably attached to the machine. Provisions are also included, e.g., a food support pad, for restingly supporting the food at various levels as it protrudes downwardly from the bottomless hopper. An interchangeable reciprocatable food processable element, e.g., a knife or a shredder/grater element, etc., workingly engages the food by cyclically moving within a horizontally disposed plane situated between the hopper and the adjustable food support pad, i.e., whereby slices of various thicknesses may be made. Ejector structure cyclically ejects particles of the processed food, e.g., slices of okra and the like, downwardly away from the food processable element. Particular structure, i.e., receptacle means, is also included for collecting the ejected slices of food to facilitate subsequent indefinite storage thereof in a typical food freezer.

The particular manner in which the food processor of the present invention accomplishes the above will be more apparent from the particular specification to follow.

DESCRIPTION OF THE PREFERRED EMBODIMENT

Figure 16:
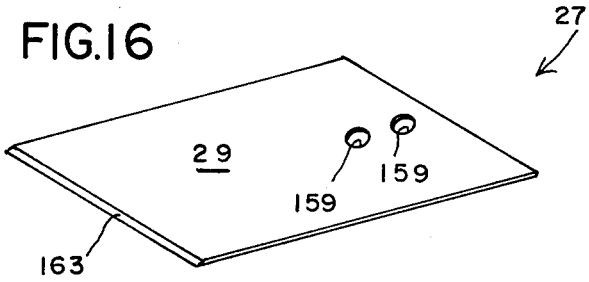
FIG. 16 is an isometric view depicting one embodiment of the food processable element which is shown detached from the device.

The food processor 11 of the present invention generally comprises a frame member, as at 13, with bottomless food hopper means, as at 15, being removably attached thereto in a manner to be described later in the specification. The food hopper means 15 is provided with an upwardly directed input opening as at 17 in FIG. 1 of the drawings, for receiving the food preparatory to being processed and a downwardly directed discharge opening, as at 19, as best shown in FIG. 10 of the drawings. Also included are food support means generally indicated at 21 in FIGS. 1 and 8–10 of the drawings and which is disposed adjacent the food discharge opening 19 for restingly engaging the lower most portion of the food contained within the hopper means 15. The manner in which the food is received in the principal embodiment of the hopper means 15 is considered mundane, therefor, in the interest of simplicity and/or brevity, the food, as such for this embodiment, will not be shown in the drawings. In this regard, it will be seen later in the specification that the food processor 11 is quite versatile and includes numerous attachments for processing a wide variety of different types of foods. Accordingly, it may be desirable to diagrammatically depict one form of food in conjunction with one alternate embodiment of the hopper means.

Figure 1:
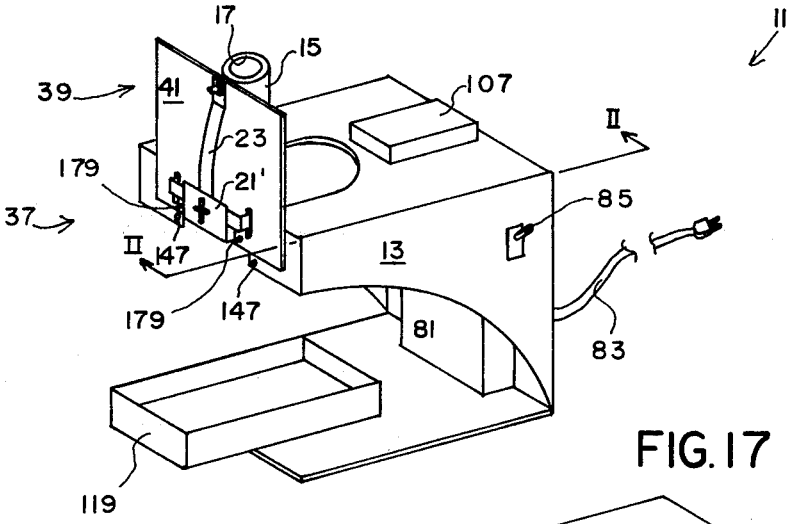
FIG. 1 is a perspective view of the food processor of the present invention as shown with a simple pan which may be used for collecting the food as it is processed.
Figure 2:
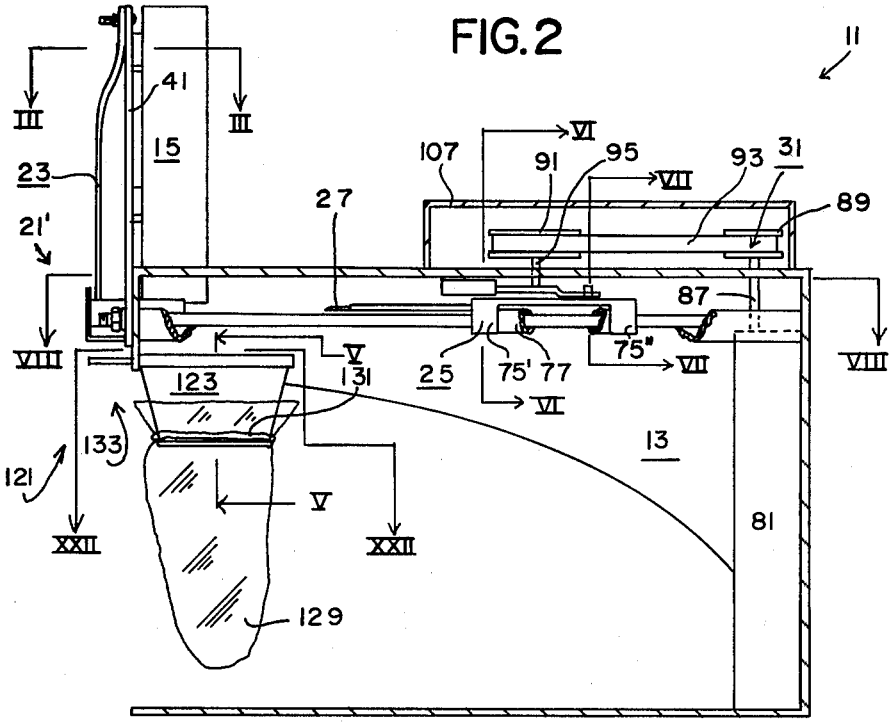
FIG. 2 is a sectional view taken as on the line II—II of FIG. 1 but which additionally shows particular receptacle means for collecting the food as it is processed.
Figure 8:
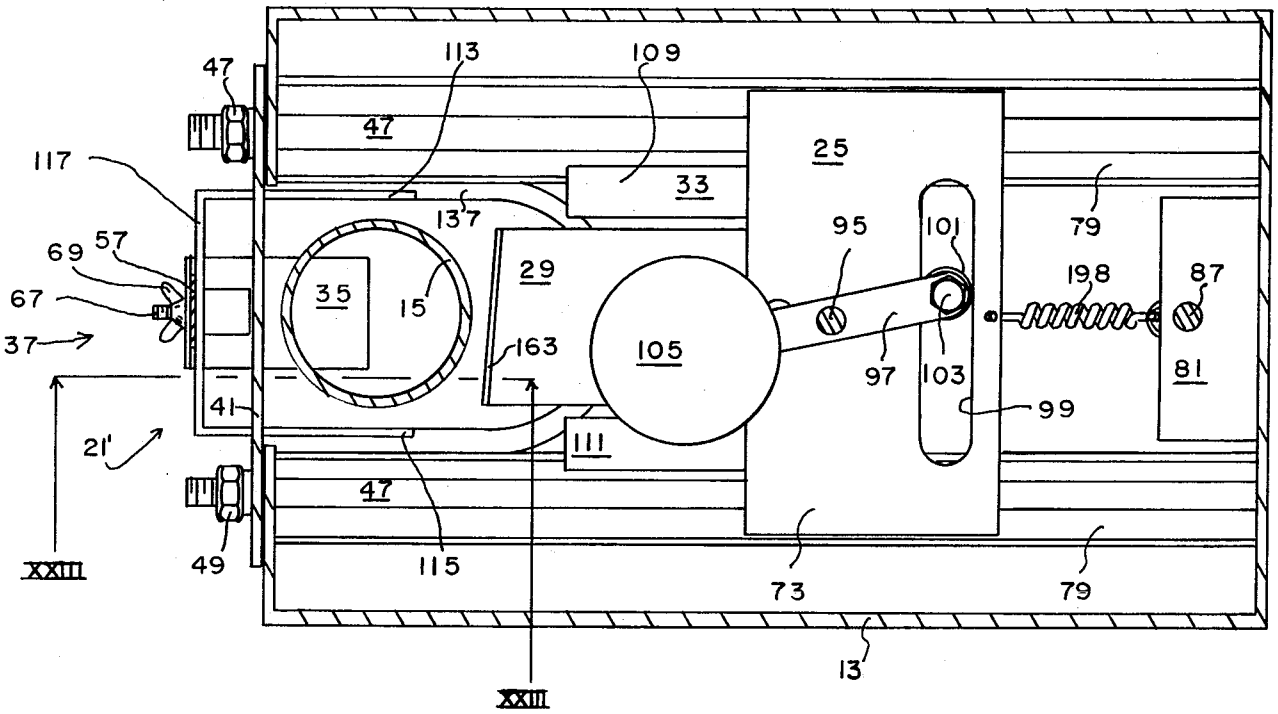
FIG. 8 is a sectional view taken as on the line VIII—VIII of FIG. 2.
Figure 9:
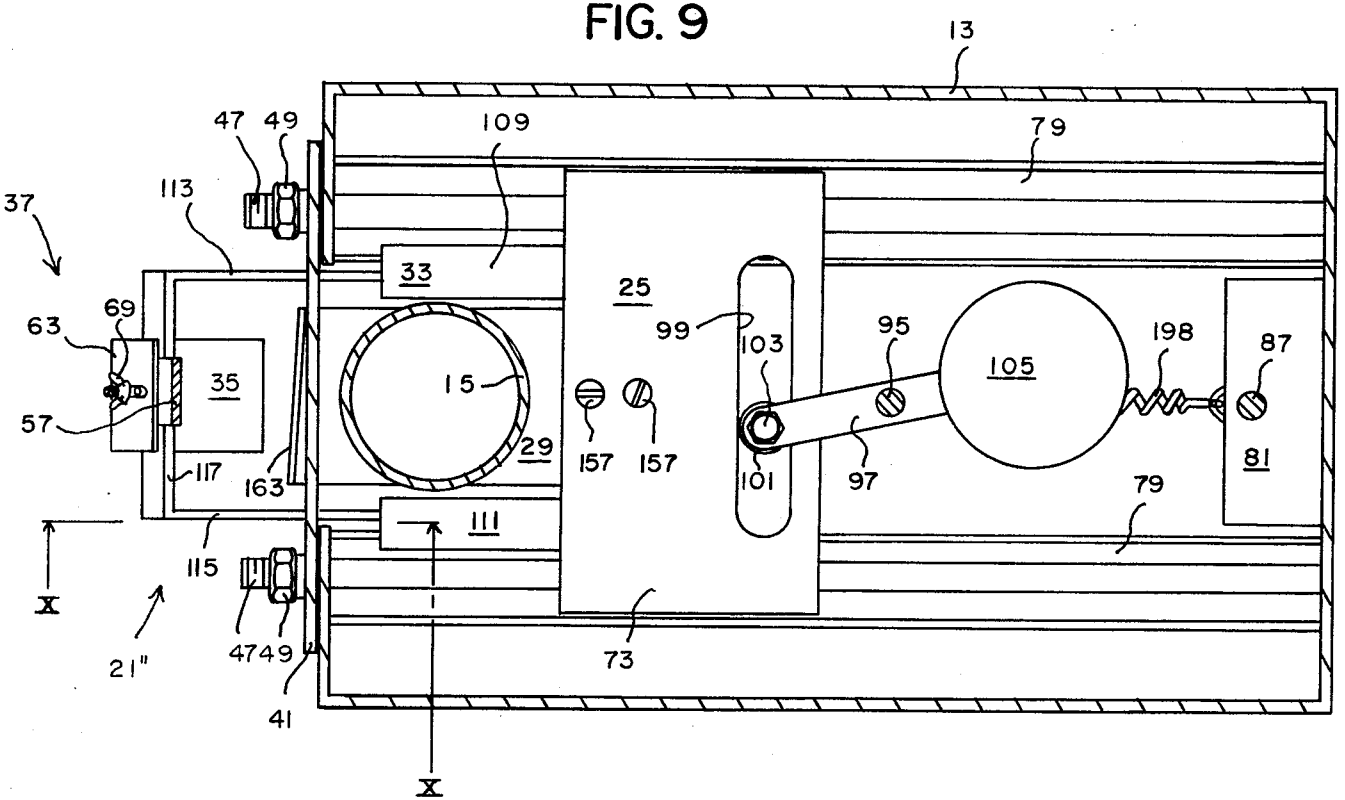
FIG. 9 is a view similar to FIG. 8 but which shows certain structure in a displaced position therefrom.
Figure 10:
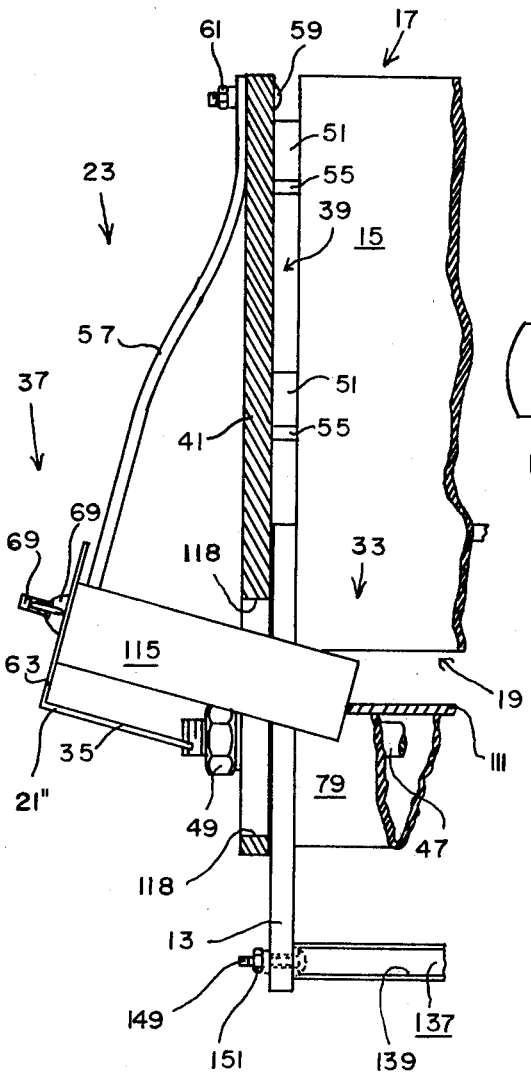
FIG. 10 is a sectional view taken as on the line X—X of FIG. 9 with certain portions shown broken away for clarity.

The food processor 11 also includes means generally indicated at 23 for swingably attaching the food support means 21 to the frame member 13 with the food support means 21 being free to swing between a first position, best shown in FIGS. 1, 2, 8 of the drawings and characterized therein by the numeral 21 having a prime suffix, thus 21'; and a second position, best shown in FIGS. 9 and 10 of the drawings and characterized therein by the numeral 21 having a double prime suffix, thus 21''. The first position of the food suppots means 21' is in alignment with the food discharge opening 19 while the second position thereof 21'' is displaced from the food discharge opening 19.

The food processor 11 also includes a carriage assembly 25 which is slidably attached to the frame member 13 for slidable movement within a horizontal plane toward and away from the food hopper means 15. Additionally, a food processable element, generally indicated at 27 in FIG. 2 of the drawings, is included and which is removably attached to the carriage assembly 25 for workingly engaging at least a portion of the food, i.e., usually the lower portion thereof. In this regard, it will be seen as the specification proceeds that several embodiments of the food processable element 27 are disclosed herewith, e.g., one of which includes knife-like means 29, as best shown in FIG. 10 of the drawings and to be fully described later in the specification.

The food processor 11 also includes drive means generally indicated at 31, and which is coupled to the carriage assembly 25 for causing the reciprocating movement thereof. The food processable element 27 is, therefore, arranged to cyclically pass beneath the food discharge opening 19. Also included are ejector means, generally indicated at 33, which coact with the carriage assembly 25 and the food support means 21 for ejecting particles of processed food downwardly away from the food processable element 27 by causing the food support means 21 to be moved between the first position 21' and the second position 21'' thereof.

From FIGS. 8–10 of the drawings it may clearly be seen that the food support means 21 includes a food support pad member 35 for restingly supporting the food contained within the hopper 15. Further, it may be seen that adjustment means, as at 37, is included for adjustably positioning the support pad member 35 at various selectable distances below the horizontal plane in which the food processable element 27, e.g., specifically the knife-like means 29, cyclically travels.

The food processor 11 also includes front plate means generally indicated at 39 in FIGS. 1 and 2 of the drawings as shown disposed in a vertical plane. The front plate means 39 includes several specific embodiments with merely the first of such embodiments being clearly shown in FIGS. 11 and 12 of the drawings and characterized therein by the numeral 41. The front plate means 39 is removably attached to the frame member 13 for coacting with the food processable element 27 in various manners to be fully disclosed as the specification proceeds.

Figure 11:
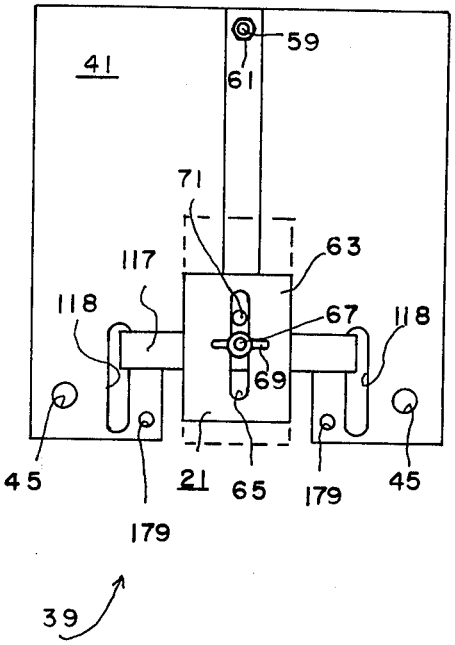
FIG. 11 is a front elevational view of one embodiment of the front plate means of the device and which is shown detached therefrom, but having the ejector means attached to the plate means.
Figure 12:
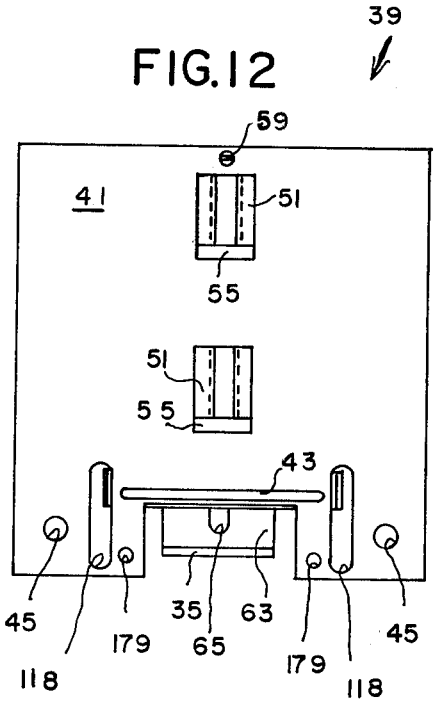
FIG. 12 is a gear elevational view of the front plate means as shown in FIG. 11.

More specifically, particular detachable food processable elements 27 coact with specific detachable plate means 39 for processing specific types of foods. In other words, as previously mentioned, one such food processable element is shown in FIG. 16 as knife-like means 29 for slicing any one of various kinds of food, e.g., carrots, cucumbers, okra, and the like, as it gravitates downwardly through the food discharge opening 19. The knife-like means 29 cyclically passes subjacent the food discharge opening. Further, the front plate means 39 of this latter arrangement, e.g., the first embodiment 41 thereof, as shown in FIGS. 11 and 12, is provided with a horizontally disposed slot 43 into which the knife-like means 29 enters with each cycle thereof. The adjustment means 37 (to be fully disclosed) enables the carrot, or the like, to be selectively sliced into numerous slices of various thicknesses.

It should be understood that the food hopper means 15 preferably is removably attached directly to the front plate means 39, in a manner about to be disclosed, rather than being removably attached to the frame member 13 per se as previously stated. The first embodiment 41 of the front plate means (FIGS. 11, 12) is provided with a pair of attachment apertures 45 which receive a pair of threaded rods 47 in a manner as best shown in FIGS. 8–10 of the drawings. The first embodiment 41 of the front plate means contiguously engages the front portion of the frame 13 and is removably attached thereto by a pair of nuts 49. A more meaningful purpose for the rods 47 will be disclosed later in the specification. Therefore, it should be understood that in the event it is desirable that the food processor 11 be limited to merely the first embodiment 41 of the front plate means, the apertures 45 may be eliminated since the front plate means 39 would, in this event, preferably be fixedly attached to the frame 13, in any well known manner as by welding or the like, or by being integrally formed therewith, thus constituting the front panel of the frame member 13, i.e., then being part and parcel of the frame member 13.

Figure 3:
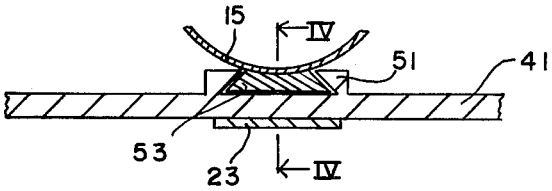
FIG. 3 is a sectional view taken as on the line III—III of FIG. 2, with FIG. 3 being rotated 90° counterclockwise.
Figure 4:
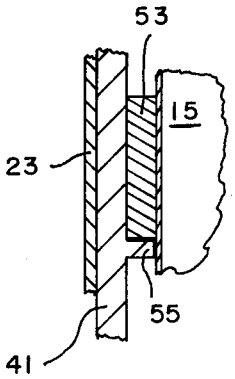
FIG. 4 is a sectional view taken as on the line IV—IV of FIG. 3.
Figure 5:
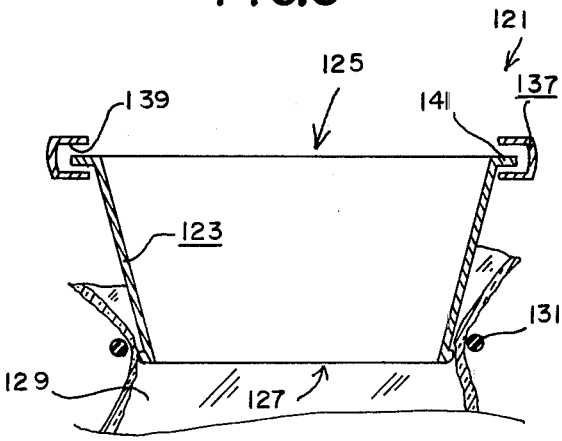
FIG. 5 is a sectional view taken as on the line V—V of FIG. 2.

In either event, the food hopper means 15 preferably is removably attached to the remaining structure of the food processor 11 in any expedient manner and in accordance with the current state of the art. In this regard, an interlocking arrangement of dove-tail elements 51, 53 are incorporated in duplicate for removably attaching the food hopper 15 to the first embodiment 41 of the front plate means, i.e., from FIG. 10 of the drawings it may be seen that an upper and lower arrangement of the dove tail elements 51, 53 are included. From FIG. 3 of the drawings it may be seen that the dove-tail element 51, being the female member, is fixedly attached to the plate means 41 for slidably receiving the male dove-tail element 53 which is fixedly attached to the food hopper means 15, i.e., the dove-tail elements 51, 53 being fixedly attached to their respective members in any well known manner, as by welding or the like. Each of the dove-tail elements 51 terminates adjacent the lowermost edges thereof with stop members 55 for engaging the lowermost porton of the male dove tail element 53, in a manner well known to those skilled in the art and as best shown in FIG. 4 of the drawings. Obviously, constructing the dove-tail elements so as to have tapered sides would eliminate the necessity for the stop members 55.

The ejector means 33 alluded to above includes bias means, e.g., a leaf spring member 57 or the like, for yieldably urging the food support means 21 toward the first position 21' thereof. In this regard, it should be understood that the leaf spring member 57 also constitutes the means 23 for swingably attaching the food support means 21 to the frame member 13. More specifically, the upper end of the leaf spring member 57 is suitably attached to the plate means 41 as with a bolt and nut 59, 61 like that shown in FIG. 10. The food support means 21 includes the previously mentioned food support pad member 35 which is substantially horizontally disposed and an upper flange member 63 which is substantially perpendicular with the support pad member 35 and as best shown in FIGS. 10, 11 of the drawings. Particular attention is now directed to FIGS. 11, 12 wherein it may be seen that the adjustment means 37 alluded to above includes providing the upper flange member 63 with a vertically aligned elongated aperture 65 for receiving a bolt 67. One end of the bolt 67 is fixedly attached to the lower end of the leaf spring member 57, in any well known manner as by spot welding or the like, with the free end thereof being slidably received within the aperture 65. A wing nut 69 is provided for threadedly engaging the bolt 67, thus the upper flange member 63 may be attached to the leaf spring member 57 selectively at various locations along the length of the aperture 65. Therefore, the food support pad member 35 may be adjusted at various selectable distances below the horizontal plane in which the food processable element 27 cyclically travels. An alignment pin as at 71 preferably is included for maintaining proper orientation of the food support pad member 35, i.e., the alignment pin 71 (FIG. 11) also is slidably received in the elongated aperture 65. The alignment pin 71 is fixedly attached to the leaf spring member 57 in a like manner as mentioned for the bolt 67. Therefore, the thickness of the sliced particle of food is predeterminable to be equal to the adjusted distance between the horizontal plane in which the food processable element 27 travels and the food support pad 35.

Figure 6:
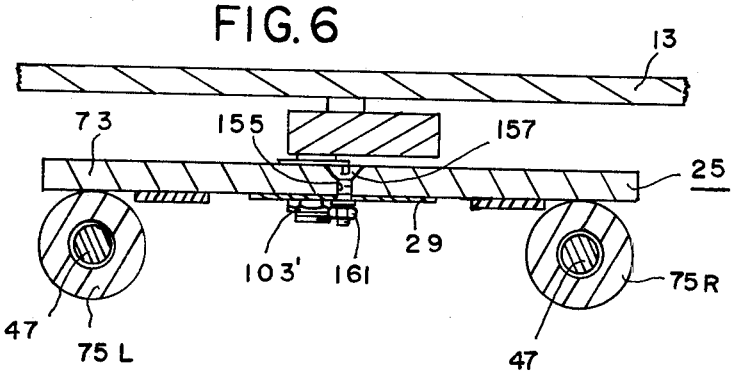
FIG. 6 is a sectional view taken as on the line VI—VI of FIG. 2.
Figure 7:
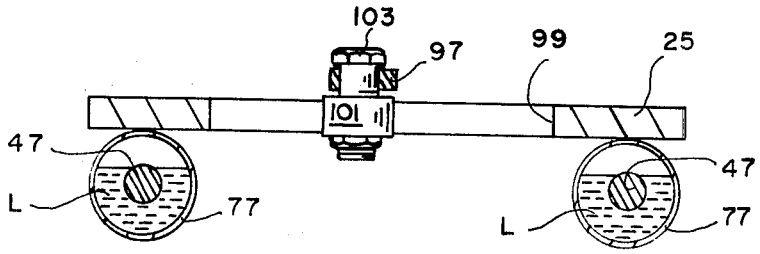
FIG. 7 is a sectional view taken as on the line VII—VII of FIG. 2.

The carriage assembly 25 alluded to above includes the previously mentioned threaded rods 47 which extend from the back wall of the frame member 13 to the front wall thereof as shown in FIGS. 2, 6, 7 et al of the drawings. Also included therewith is a platform 73 which is slidably supported upon the rods 47 by incorporating a plurality of sleeve members which circumferentially engage the rods 47, in a manner well known to those skilled in the art. The sleeve members 75 preferably are arranged so as to constitute a left section 75L and a right section 75R as viewed in FIG. 6 of the drawings. Each of the sections 75L and 75R include a forward and rearward sleeve element 75', 75'' as best shown in FIG. 2 of the drawings. A lubricating tubular member 77 (FIGS. 2, 7) preferably is interposed between the forward and rearward sleeve elements 75', 75'' and is sealably attached thereto so as to be filled with a lubricant, in any well known manner, i.e., the lubricant is indicated in FIG. 7 by the letter "L". From FIGS. 2 and 8–10 of the drawings it may clearly be seen that each rod 47 is provided with a shroud-like debris collector or trough member 79 which is disposed beneath the rod 47 for the purpose of collecting any extraneous lubricant L and/or the like.

The drive means 31 alluded to above includes an electric motor 81, as diagramatically depicted in FIGS. 1 and 2, which is energized by a power cord 83 that may be connected to any convenient household current outlet. The motor 81 may selectively be energized by a simple on and off toggle switch 85 in a conventional manner. The electric motor 81, having an output shaft 87 thereof extending upwardly through the frame member 13, rotatably drives a pulley or a sprocket, as at 89, which in turn rotatably drives a pulley or sprocket 91 through an endless belt or chain 93. Likewise, if desired, the pulleys 89, 91 may be deleted and spur gears incorporated in lieu thereof in any manner well known to those skilled in the art. In either event, the pulley 91 or the like rotatably drives a power input shaft 95 which in turn drives a pitman arm 97 or the like as best shown in FIGS. 8 and 9 of the drawings. The platform 73 is provided with an elongated slot 99 (FIGS. 7–9) having the major axis thereof extending substantially perpendicular with the rods 47. The slot 99 receives a sealed roller bearing 101 or the like. The roller bearing 101 is rotatably attached to one end of the pitman arm 97 by attachment means 103, e.g., constituting a bolt and nut 103, 103' or the like. A counterweight 105 is fixedly attached to the end of the pitman arm 97 which is remote from the roller bearing 101. Therefore, rotation of the power input shaft 95 causes reciprocating movement of the carriage assembly 25.

The pulleys 89, 91 or the like preferably are enclosed by a housing member 107 which may be removably attached to the frame member 13 in any well known manner as with screws (not shown) or the like.

Particular attention is now directed towards FIGS. 8 through 10 of the drawings wherein it may be seen that the ejector means 33 alluded to above includes at least one push rod member, but preferably a pair of push rod members as at 109, 111, which is/are fixedly attached in any well known manner, as by welding or the like, to the carriage assembly 25. The push rod members 109, 111 reciprocate with the carriage assembly 25 for engaging and cyclically driving the food support means 21 from the first position 21' to the second position 21'' thereof. Of course, the bias means, i.e., the leaf spring member 57, returns the food support means 21 to the first position 21' thereof.

Additionally, the ejector means 33 preferably includes at least one arm member, but preferably a pair of arm members as at 113, 115, which is/are fixedly joined to the outer ends of a single coupler member 117 which is fixedly attached centrally thereof to the lower end of the leaf spring member 57, in any well known manner as spot welding or the like. From FIGS. 10–12 of the drawings it may clearly be seen that the front plate means 41 is provided with a pair of vertically disposed parallel spaced apart elongated apertures 118 for free passage therethrough of the arm members 113, 115 as the food support means 21 is being moved between the first position 21' and the second position 21'' thereof in the manner as above disclosed. Neither the arm members 113, 115 nor the coupler member 117 move up and down with the upper flange member 63 (FIG. 11), i.e., the arm members 113, 115 are supported by the single coupler member 117 which is, as mentioned above, permanently attached to the lower end of the leaf spring 57.

Although, it may readily be seen that the arm members 113, 115 may be described as being fixedly attached (via the bolt 67 and nut 69) to the food support meanss 21 even though the adjustment means 37 merely adjusts the food support means 21, i.e., loosening of the wing nut 69 enables the upper flange member 63 to be free to slide vertically along the length of the elongated aperture 65 as best shown in FIG. 11 of the drawings.

Further, it may be seen in FIGS. 8, 9 that the arm members 113, 115 reach a predetermined distance towards the carriage assembly 25 for movement with the food support means 21 between the first position 21' and the second position 21'' thereof. Therefore, the above described arrangement readily enables the arm members 113, 115 and the push rod members 109, 111 to jointly drive the food support means 21 from the first position 21' to the second position 21'' thereof with the bias means or leaf spring member 57 returning the food support means 21 to the first position 21' thereof.

From FIG. 1 of the drawings it may readily be seen that a typical kitchen utensil, e.g., a sauce pan 119 or the like, could be positioned beneath the food hopper means 15 for collecting the ejected particles of processed food as they are being processed. However, the food processor 11 preferably includes particular receptacle means, as at 121 in FIGS. 2, 5, 10 and 22 of the drawings which is disposed beneath the ejector means 33 for collecting the ejected particles of processed food as they gravitate therefrom.

The receptacle means 121 includes a funnel-like member 123 having an upwardly directed wide mouth-like opening 125 for initially receiving the ejected particles of food and a downwardly directed output opening 127. The receptacle means 121 also includes a pliant bag-like member 129 having a suitable size for readily accommodating the insertion, at least partially therein, of the downwardly directed output opening 127, whereby, the particles of processed food may readily be conveyed into the pliant bag-like member 129. Also, included is an elastic tie means 131 which removably and circumferentially engages the bag-like member 129 and the funnel-like member 123 for holding them intact during the filling process of the bag-like member 129. The receptacle means 121 also includes support means 133 as best shown in FIG. 22 for removably attaching the funnel-like member 123 to the frame member 13 and for supporting the funnel-like member 123 in an optimum position during the filling process of the pliant bag-like member 129.

Figure 22:
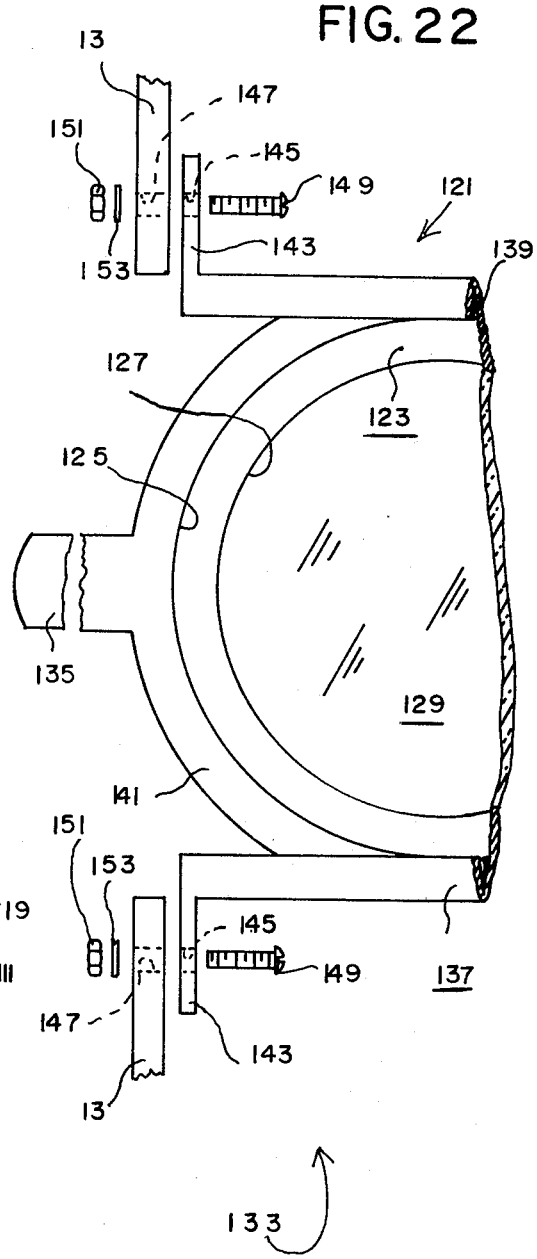
FIG. 22 is a sectional view taken as on the line XXII—XXII of FIG. 2.

More specifically, the funnel-like member 123 includes a handle, as at 135 in FIG. 22, which may be of any convenient length for facilitating engaging the funnel-like member 123 with the support means 133. Additionally, the support means 133 includes a horseshoe shaped cantilever member 137 constructed so as to have the rim thereof defining an inwardly directed groove as at 139 in FIG. 5 of the drawings. The funnel-like member 123 also includes an annular lip or ridge portion 141 for removably engaging the groove 139 as clearly shown in FIG. 5 of the drawings. The cantilever member 137 may be removably attached to the frame member 13 in the following manner: the cantilever member 137 terminates at either end thereof with out-turned flange-like members 143 which are provided with apertures 145. The apertures 145 may be aligned with mating apertures 147 provided in the frame member 13, as clearly shown in FIGS. 1 and 22 of the drawings. Accordingly, a pair of bolts 149 may be inserted through the aligned apertures 145, 147 and properly secured to the frame member 13 by a pair of nuts and washers 151, 153.

The pliant bag-like member 129 preferably is formed from a transparent material, e.g., plastic film or the like, so that the contents may be observed particularly during the filling process thereof. Additionally, the bag-like member 129 facilitates preparing food for the typical home freezer. In other words, immediately following the processing of the food by the food processor 11, the filled pliant bag-like member 129 may be closed in any conventional manner and immediately placed in the food freezer. Thus, all of the intermediate steps normally associated with processing vegetables, e.g., okra and the like, are eliminated.

The knife-like means 29, as clearly shown in FIGS. 8, 9 of the drawings, may be removed from the carriage assembly 25 in the following manner: The carriage assembly 25 is provided with a pair of apertures, as at 155 in FIG. 6, adapted for receiving a pair of flat head screws 157 in a flush manner. Additionally, the knife-like means 29 is provided with a pair of apertures 159, as clearly shown in FIG. 16, which may be aligned with the apertures 155. Thus, the screws 157 are also received in the apertures 159 and are secured in place by a pair of nuts 161. The forward edge of the knife-like means 29 is provided with a sharpened portion, as at 163, which may readily be resharpened on any conventinal carborundom stone or the like. For obvious reasons, it may be beneficial that the sharpened portion 163 be angularly disposed as suggested in FIGS. 8 and 9 of the drawings.

DESCRIPTION OF THE ALTERNATE EMBODIMENTS

Figure 17:
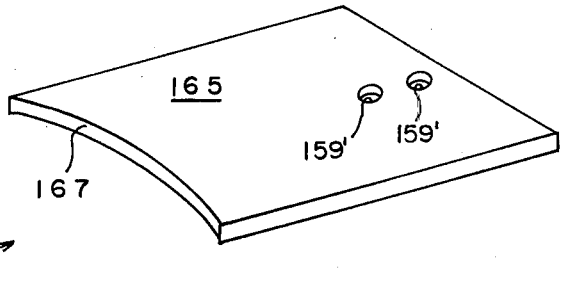
FIG. 17 is a view similar to FIG. 16 but which depicts one alternate embodiment of the food processable element, while FIGS. 18, 19 respectively depict still other alternate embodiments thereof.
Figure 23:
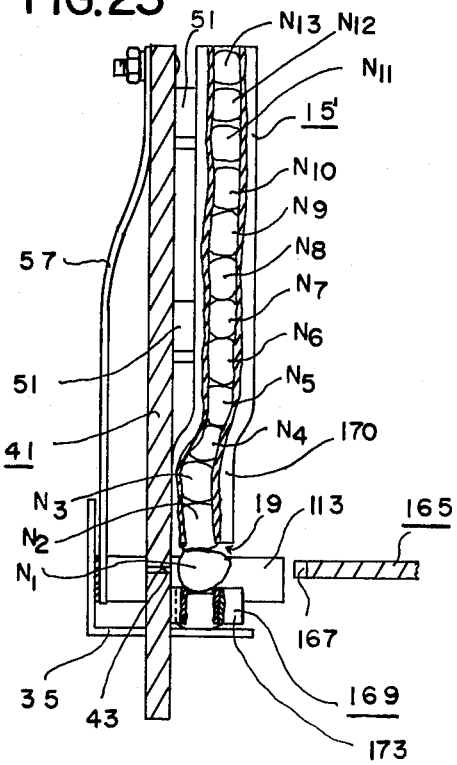
FIG. 23 is an over simplified somewhat diagramatic sectional view taken as on the line XXIII—XXIII of FIG. 8 with the attachments shown in FIGS. 17, 21 being attached to the food processor and with considerable structure being deleted for brevity.

From FIGS. 17, 23 of the drawings it may be seen that the food processable element 27 may optionally include blunt ram-like means 165 for workingly engaging a particular kind of food, e.g., English Walnuts or the like. The walnuts will naturally gravitate downwardly through the food discharge opening 19 with the ram-like means 165 cyclically passing subjacent thereto. In this arrangement, the front plate means 39 acts as a buttress by providing lateral support of one side of the food (English Walnuts) while the opposite side thereof is being workingly engaged by the ram-like means 165. Accordingly, the ram-like means 165 is provided with a pair of apertures 159' which are similar to the apertures 159 provided in the knife-like means 29. Therefore, the screws 157 and nuts 161 may also be used in attaching the blunt ram-like means 165 to the carriage assembly 25. The forward portion of the ram-like means 165 is preferably provided with an arcuate blunt portion, as at 167, for readily cracking the nuts and the like.

It will readily be appreciated, that certain types of food, e.g., English Walnuts and the like, may not be adequately supported merely by the food support pad member 35, i.e., the nuts could possibly roll off of the food support member 35. Therefore, the food support means 21 additionally includes, as an option, food encompassment retainer means, as at 169 and clearly shown in FIG. 21, as it would appear detached from the food processor 11. Moreover, the food encompassment retainer means 169 is also shown in FIG. 23 of the drawings as it wouold appear when attached to the food processor 11.

Figure 21:
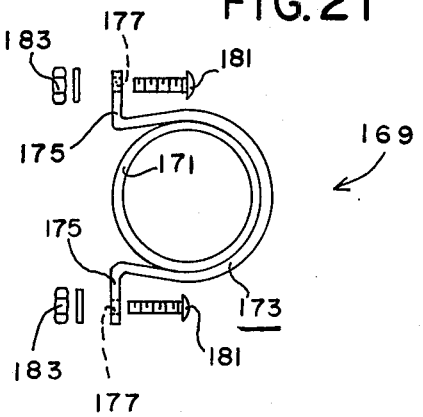
FIG. 21 is a top view looking down on the food encompassment retainer means which is shown detached from the device.

Accordingly, particular attention is now directed towards FIGS. 21 and 23 of the drawings where it may be seen that the food encompassment retainer means 169 coacts with the food support pad member 35 for providing lateral restraint of a first portion of the food restingly supported by the food support pad member 35, i.e., the first portion of the food alluded to might be an English Walnut or the like characterized by the capital letter N having a sub-numeral 1 suffix, thus $N_1$. FIG. 23 also discloses an alternate embodiment of the bottomless food hopper means and which is characterized by the numeral 15 having a prime suffix, thus 15'. The hopper means 15' differs only slightly from the principal embodiment thereof in that it includes an offset portion as at 170 thereby juxtapositioning the discharge opening 19 thereof with the front plate means 39, i.e., the first embodiment thereof.

Since the offset portion 170 merely compensates for the thickness of the dove-tail member 51, 53 it (the offset 170) may be unnecessary in the event the hopper 15 is attached to the front plate 41 in some other way, e.g., welding or the like. The hopper means 15' is shown in a fully loaded condition wherein a plurality of nuts N are shown and are individually designated as $N_1$, $N_2$, $N_3$, etc. The first portion of the food, i.e., the nut $N_1$, merely supports the nut $N_2$ disposed superjacent thereto. Therefore, the nut $N_1$ acts only as a support and does not get cracked. Although, as the carriage assembly 25 is caused to reciprocate, each cycle thereof is effective in ejecting the lowermost, or the first nut $N_1$ and allowing the succeeding nuts $N_2$, $N_3$, etc., to move or drop downwardly in succession for in turn processing.

From FIG. 23 of the drawings it may readily be seen that the food encompassment retainer means 169 is disposed below the horizontal plane in which the blunt ram-like means 165 cyclically travels. Therefore, the ram-like means 165 cyclically passes between the food discharge opening 19 and the food encompassment means 169 with the front plate means 39, i.e., the first embodiment 41 thereof, acting as a buttress by providing lateral support of one side of a second portion of the food, i.e., nut $N_2$, as the opposite side of the nut $N_2$ is workingly engaged (or cracked) by the ram-like means 169, i.e., the first portion of food or the nut $N_1$ is subjacent to and restingly supports the second portion thereof or the nut $N_2$.

From FIG. 21 of the drawings it may be seen that the food encompassment retainer means 169 includes an annular ring member 171 fixedly joined to a clamp member 173, in any well known manner as by spot welding or the like. Additionally, the clamp member 173 terminates at either end thereof with outwardly directed flange members 175 which are provided with apertures 177. The apertures 177 may be aligned with a pair of mating apertures 179 provided in the plate-like member 41 as indicated in FIG. 1 but more clearly shown in FIGS. 11 and 12 of the drawings. Therefore, a pair of bolts 181 (FIG. 21) may be received in the aligned apertures 177, 179 for removably attaching the food encompassment retainer means 169 to the plate member 41. The bolts 181 may be secured by encorporating a pair of nuts 183.

Figure 13:
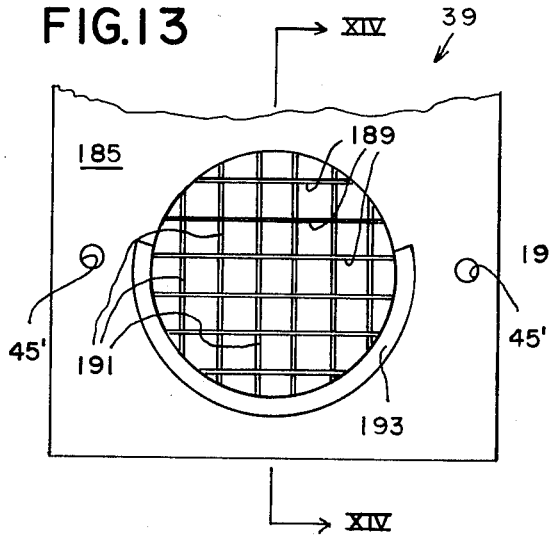
FIG. 13 is a partial front elevational view showing a second embodiment of the front plate means.
Figure 14:
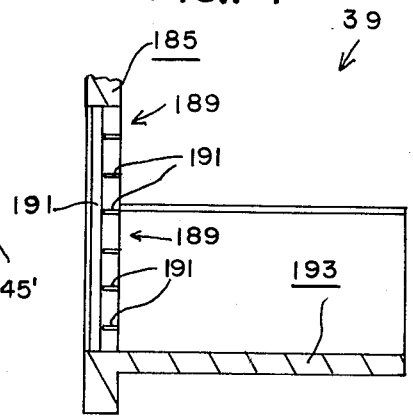
FIG. 14 is a sectional view taken as on the line XIV—XIV of FIG. 13.
Figure 19:
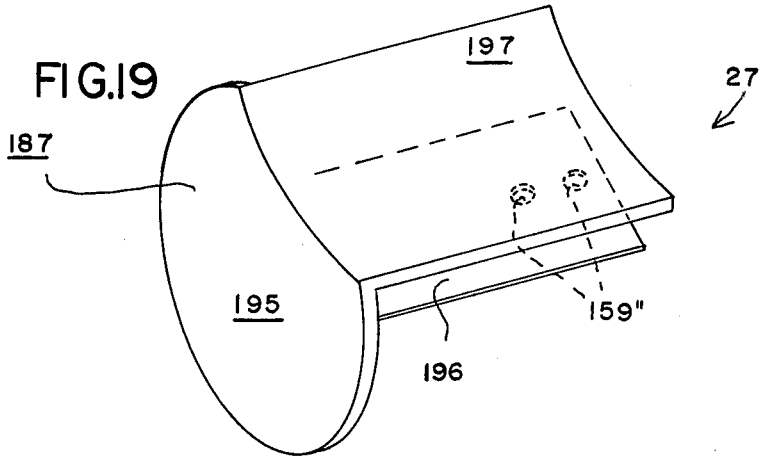

Particular attention is now directed toward FIGS. 13, 14 and 19 where it may be seen that the front plate means 39 includes an alternate embodiment thereof which is characterized by the numeral 185. Also, another embodiment of the food processable element 27 is shown and characterized in FIG. 19 by the numeral 187. Moreover, the plate means 185 includes a plurality of juxtaposed fenestrations (characterized by the numeral 189 and defined by grid-like knife edge divider means 191) for cutting a particular kind of food, e.g., potatoes and the like, into multiple finger-like particles, e.g., french fried potatoes, as the potato is urged through the plurality of fenestrations 189.

The plate-like means 185 includes an arcuate trough-like member 193 for restingly supporting the particular kind of food alluded to above, i.e., a potato. The food processable element 27, or the alternate embodiment 187 thereof as shown in FIG. 19, includes broad planar means, or a crescent-shaped pusher as at 195, disposed in a verticle plane and situated parallel with the front plate means 185 for urging the food, i.e., a potato, through the juxtaposed fenestrations 189 as the crescent-shaped pusher 195 cyclically passed subjacent to the food discharge opening 19.

Figure 20:
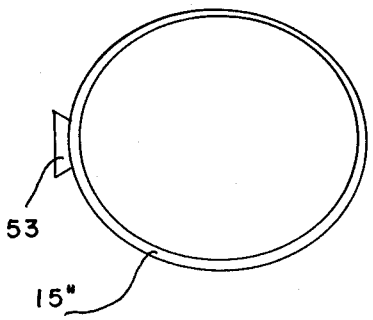
FIG. 20 is a top view looking down on an alternate embodiment of the food hopper, with the hopper being detached from the device.

In this regard, it should be pointed out that it may be desirable that the hopper means 15 be particularly adapted to the size and shape of a potato. Therefore, another embodiment of the hopper means is disclosed herewith and is clearly shown in FIG. 20 of the drawings and is characterized therein by the numeral 15 having a double prime suffix, thus 15''. Therefore, the hopper means 15'' is adapted to conform to an optimum shape and size for receiving potatoes. Additionally, it includes dove-tail elements 53 for facilitating engagement with the dove-tail elements 51 previously described, i.e., the plate means 185 is like the plate means 41 in that both include the previously described dove-tail element 51.

The food processable element 27 or more specifically the alternate embodiment 187 thereof, also includes a horizontally disposed plate-like portion 196 which corresponds to the knife-like means 29 (FIG. 16). In other words, the plate-like member 196 travels in the same horizontal plane as the knife-like means 29 and the crescent-shaped pusher 195 is fixedly attached to the forward end thereof. Accordingly, the plate-like member 196 is provided with a pair of apertures 159'' which correspond to the apertures 159, i.e., facilitating attaching the food processable element 187 to the carriage assembly 25 in like manner. Accordingly, the crescent-shaped pusher 195 is adapted to slightly engage the front plate means 185 as the carriage assembly 25 moves to its forwardmost position.

In order to facilitate continuous processing of a hopper full of potatoes, the food processable element 187 also includes an arcuate horizontally disposed stop member 197 which is situated a spaced somewhat parallel distance above the plate-like member 196. Therefore, as the crescent-shaped pusher 195 moves to a forward position, it urges merely the lowermost potato through the fenestrations 189. However, the next to the bottom potato is being restingly supported by the stop member 197, thus being precluded from dropping in behind the crescent-shaped pusher 195 as it moves forward. Accordingly, as the stop member 197 subsequently moves rearwardly, the potato which was restingly supported thereon is now free to drop down onto the arcuate trough-like member 193 for ultimate processing into finger-like french fry portions. Obviously, this process is continuously repeated as long as the hopper 15'' is loaded.

Although, it may be desirable to simply remove the hopper means 15'' entirely when making french fries, i.e., whole potatoes may be placed upon the trough-like member 193 one at a time. Of course, the switch 85 must first be placed in the "off" position when the potato is being placed upon the trough-like member 193. In this regard, it would be most desirable to provide structure for returning the carriage assembly to its rearward position at any time in which the motor 81 is caused to cease operation. Therefore, the food processor 11 includes a carriage return spring, as best shown in FIGS. 8, 9 of the drawings and characterized therein by the numeral 198. The spring 198 is a typical pull spring which is suitably attached between the carriage assembly 25 and the housing for the motor 81. Accordingly, the pull spring 198 will have sufficient power to pull the carriage assembly 25 rearward to a "ready" position as the switch 85 is placed in the "off" position.

Figure 15:
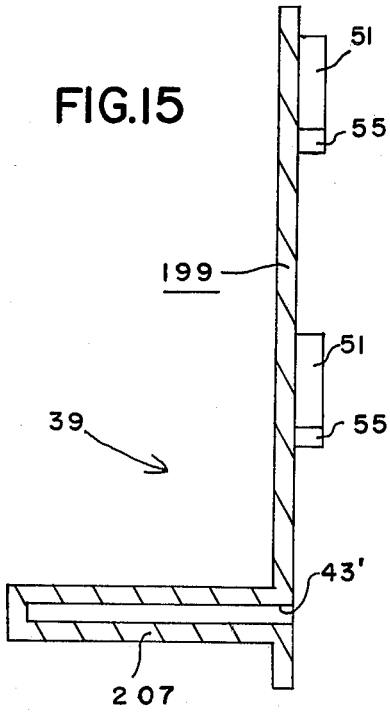
FIG. 15 is a sectional view similar to FIG. 14 but which depicts a third embodiment of the front plate means.
Figure 18:
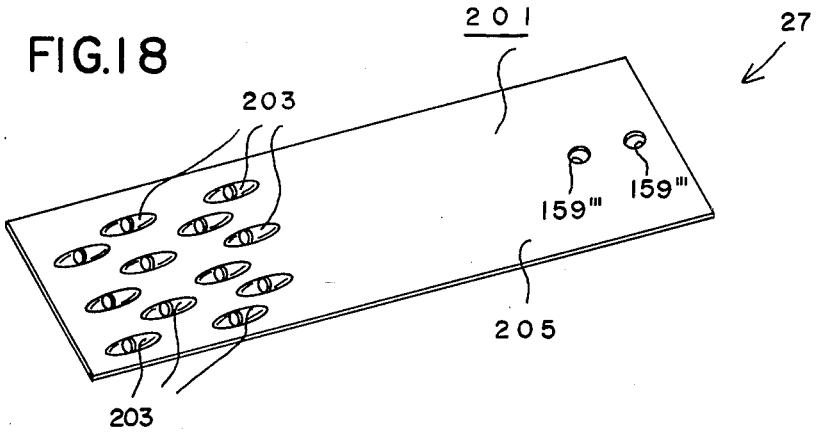

Particular attention is now directed towards FIGS. 15, 18 of the drawings wherein it may be seen that still other respective embodiments of the front plate means 39 and the food processable element are disclosed. More specifically, FIG. 15 clearly shows an alternate embodiment of the front plate means which is characterized therein by the numeral 199 while FIG. 18 clearly shows an alternate embodiment of the food processable element which is characterized therein by the numeral 201.

The food processable element 201 includes plate-like shredder/grater means or elements as at 203, disposed in a horizontal plane for selectively shredding and grating any one of various kinds of food, e.g., cabbage, coconut meat or the like, as it is manually urged downwardly through the food discharge opening 19. Of course, the shredder/grater means 203 is reciprocatingly moving subjacent to the food discharge opening 19. The food processable element 201 also includes a plate-like portion 205 which corresponds to the knife-like means 29. In other words, the plate-like portion 205 includes a pair of apertures 159''' which correspond to the previously mentioned apertures 159 provided in the knife-like means 29. Therefore, the food processable element 201 may readily be removably attached to the carriage assemby 25 in like manner as previously described for the knife-like means 29.

The front plate means 199 is provided with a horizontally disposed slot 43' which corresponds to the slot 43 provided in the front plate means 41. The plate-like shredder/grater means 203 slidably passes through the slot 43' as it reciprocates with the carriage assembly 25. Accordingly, the slot 43' is defined by shroud means 207 for guarding the shredder/grater means 203, i.e., precluding inadvertant personal contact with the food processable element 201 as it rapidly reciprocates to and fro.

Although the invention has been described and illustrated with respect to preferred embodiments thereof, it should be understood that is is not intended to be so limited since changes and modifications may be made therein which are within the full intended scope of the invention.

I claim:

1. A food processor comprising a frame, food hopper means removably attached to said frame and having an upwardly directed input opening for receiving the food preparitory to being processed and a downwardly directed discharge opening, food support means disposed subjacent said food discharge opening for restingly engaging the lowermost portion of food contained within said hopper means, means for swingably attaching said food support means to said frame with said food support means being free to swing between a first position that is in alignment with said food discharge opening and a second position that is displaced from said food discharge opening, a carriage assembly slidably attached to said frame for slidable movement within a horizontal plane toward and away from said food hopper means, a food processable element removably attached to said carriage assembly for workingly engaging at least a portion of the food, drive means coupled to said carriage assembly for causing reciprocating movement thereof with said food processable element being arranged to cyclically pass beneath said food discharge opening, and ejector means coacting with said carriage assembly and said food support means for ejecting particles of processed food downwardly away from said food processable element by causing said food support means to be moved between said first and second position thereof, said ejector means including bias means for yieldably urging said food support means toward said first position thereof, said ejector means including means associated with said carriage assembly for engaging and cyclically driving said food support means from said first position to said second position thereof, said bias means returning said food supporting means to said first position thereof.

2. The food processor as set forth in claim 1 in which said food support means includes a food support pad member for restingly supporting the food contained within said hopper means, and in which is included adjustment means for adjustably positioning said support pad member at various selectable distances below the horizontal plane in which said food processable element cyclically travels.

3. The food processor as set forth in claim 2 in which said food processable element includes blunt ram-like means for workingly engaging a particular kind of food as it gravitates downwardly through said food discharge opening with said ram-like means cyclically passing subjacent thereto, and in which said food support means additionally includes food encompassment retainer means coacting with said food support pad member and for providing lateral restraint of a first portion of the food restingly supported by said food support pad member, said food encompassment retainer means being disposed below the horizontal plane in which said blunt ram-like means cyclically travels, whereby the ram-like means cyclically passes between the food discharge opening and the food encompassment means with said front plate means acting as a buttress by providing lateral support of one side of a second portion of the food as the opposite side thereof is workingly engaged by said ram-like means, said first portion of food being subjacent to and restingly supporting said second portion thereof.

4. The food processor as set forth in claim 1 in which is included front plate means disposed in a vertical plane and being removably attached to said frame for coacting with said food processable element.

5. The food processor as set forth in claim 4 in which said food processable element includes knife-like means for repeatedly slicing any one of various kinds of food as it gravitates downwardly through said food discharge opening with said knife-like means cyclically passing subjacent thereto, and said front plate means being provided with a horizontally disposed slot into which said knife-like means enters with each cycle thereof.

6. The food processor as set forth in claim 4, in which said food processable element includes blunt ram-like means for workingly engaging a particular kind of food as it gravitates downwardly through said food discharge opening with said ram-like means cyclically passing subjacent thereto, said front plate means acting as a buttress by providing lateral support of one side of the food while the opposite side thereof is being workingly engaged by said ram-like means.

7. The food processor as set forth in claim 4 in which said front plate means includes a plurality of juxtaposed fenestrations defined by grid-like knife-edge divider means for cutting a particular kind of food into multiple uniform fingerlike particles as it is urged through said plurality of fenestrations, said food processable element includes broad planar means disposed in a vertical plane and being parallel with said front plate means for engaging and urging the food through said juxtaposed fenestrations as said broad planar means cyclically passes subjacent to said food discharge opening.

8. The food processor as set forth in claim 4 in which said food processable element includes plate-like shredder/grater means disposed in a horizontal plane for selectively shredding and grating any one of various kinds of food as it is manually urged downwardly through said food discharge opening with said shredder/grater means reciprocatably moving subjacent thereto, and said front plate means being provided with a horizontally disposed slot through which said plate-like shredder/grater means slidably passes, said slot being defined by shroud means for guarding said shredder/grater means.

9. The food processor as set forth in claim 1 in which is included receptacle means disposed beneath said ejector means for collecting the ejected particles of processed food as they gravitate therefrom, said receptacle means includes a funnel-like member having an upwardly directed wide mouth-like opening for initially receiving the ejecting particles of food and a downwardly directed output opening, a pliant bag-like member having a size for readily accommodating the insertion at least partially therein of said downwardly directed output opening whereby the particles of processed food may readily be conveyed into said pliant bag-like member, elastic tie means removably and circumferentially engaging said bag-like member and said funnel-like member for holding them intact during the filling process of said bag-like member, and support means for removably attaching said funnel-like member to said frame member and for supporting said funnel-like member in an optimum position during the filling process of said pliant bag-like member.

10. A food processor comprising a frame, food hopper means removably attached to said frame and having an upwardly directed input opening for receiving the food preparitory to being processed and a downwardly directed discharge opening, food support means disposed subjacent said food discharge opening for restingly engaging the lowermost portion of food contained within said hopper means, means for swingably attaching said food support means to said frame with said food support means being free to swing between a first position that is in alignment with said food discharge opening and a second position that is displaced from said food discharge opening, a carriage assembly slidably attached to said frame for slidable movement within a horizontal plane toward and away from said food hopper means, a food processable element removably attached to said carriage assembly for workingly engaging at least a portion of the food, drive means coupled to said carriage assembly for causing reciprocating movement thereof with said food processable element being arranged to cyclically pass beneath said food discharge opening, and ejector means coacting with said carriage assembly and said food support means for ejecting particles of processed food downwardly away from said food processable element by causing said food support means to be moved between said first and second positions thereof, said ejector means including bias means for yieldably urging said food support means toward said first position thereof, said ejector means including at least one push rod member fixedly attached to said carriage assembly and reciprocates therewith for engaging and cyclically driving said food support means from said first position to said second position thereof, said bias means returning said food support means to said first position thereof.

11. A food processor comprising a frame, food hopper means removably attached to said frame and having an upwardly directed input opening for receiving the food preparitory to being processed and a downwardly directed discharge opening, food support means disposed subjacent said food discharge opening for restingly engaging the lowermost portion of food contained within said hopper means, means for swingably attaching said food support means to said frame with said food support means being free to swing between a first position that is in alignment with said food discharge opening and a second position that is displaced from said food discharge opening, a carriage assembly slidably attached to said frame for slidable movement within a horizontal plane toward and away from said food hopper means, a food processable element removably attached to said carriage assembly for workingly engaging at least a portion of the food, drive means coupled to said carriage assembly for causing reciprocating movement thereof with said food processable element being arranged to cyclically pass beneath said food discharge opening, and ejector means coacting with said carriage assembly and said food support means for ejecting particles of processed food downwardly away from said food processable element by causing said food support means to be moved between said first and second positions thereof, said ejector means including bias means for yieldably urging said food support means toward said first position thereof, said ejector means including at least one arm member fixedly attached to said food support means and reaching a predetermined distance toward said carriage assembly for movement with said food support means between said first and second positions thereof, and at least one push rod member fixedly attached to said carriage assembly for reciprocating movement therewith and reaching a predetermined distance toward said arm member for cyclical engagement therewith as said carriage assembly reciprocates, thus enabling said arm member and said push rod member to jointly drive said food support food support means from said first position to said second position thereof, and said bias means returning said food support means to said first position thereof.

* * * * *